US012060190B2

(12) United States Patent
Bass

(10) Patent No.: US 12,060,190 B2
(45) Date of Patent: Aug. 13, 2024

(54) SYSTEM AND METHOD FOR PRINTING ON A PACKAGE

(71) Applicant: Santa Fe Natural Tobacco Company, Inc., Winston-Salem, NC (US)

(72) Inventor: Steven P. Bass, Oxford, NC (US)

(73) Assignee: Santa Fe Natural Tobacco Company, Inc., Winston-Salem, NC (US)

( * ) Notice: Subject to any disclaimer, the term of this patent is extended or adjusted under 35 U.S.C. 154(b) by 0 days.

(21) Appl. No.: 18/052,407

(22) Filed: Nov. 3, 2022

(65) Prior Publication Data

US 2023/0090786 A1 Mar. 23, 2023

Related U.S. Application Data

(62) Division of application No. 16/793,454, filed on Feb. 18, 2020, now Pat. No. 11,518,564.

(51) Int. Cl.

| | |
|---|---|
| ***B65B 61/02*** | (2006.01) |
| ***B65B 19/02*** | (2006.01) |
| ***B65B 19/22*** | (2006.01) |
| ***B65B 19/28*** | (2006.01) |
| ***B65B 57/02*** | (2006.01) |

(52) U.S. Cl.

CPC ..... *B65B 61/025* (2013.01); *B65B 19/025* (2013.01); *B65B 19/228* (2013.01); *B65B 19/28* (2013.01); *B65B 57/02* (2013.01)

(58) Field of Classification Search

CPC ... B65B 61/025; B65B 19/025; B65B 19/228; B65B 19/28; B65B 57/02

See application file for complete search history.

(56) References Cited

U.S. PATENT DOCUMENTS

| | | | | |
|---|---|---|---|---|
| 3,874,581 | A | 4/1975 | Fox et al. | |
| 3,944,066 | A | 3/1976 | Niepmann | |
| 4,746,012 | A * | 5/1988 | Simard | B65D 85/1009 206/254 |

(Continued)

FOREIGN PATENT DOCUMENTS

| | | | |
|---|---|---|---|
| DE | 102011113401 | A1 | 3/2013 |
| EP | 0392737 | B1 | 10/1993 |

(Continued)

OTHER PUBLICATIONS

International Search Report and Written Opinion for PCT Application No. PCT/US2021 /017976, dated Jun. 7, 2021.

*Primary Examiner* — Lucas E. A. Palmer

(74) *Attorney, Agent, or Firm* — Womble Bond Dickinson (US) LLP; Chris Humphrey; John V. Forcier

(57) ABSTRACT

A system for printing on a printable portion of a liner for a package to receive smoking articles includes a package assembler configured to receive an outer blank and fold the outer blank around the liner to create the package. The liner comprises a material configured to absorb ink and a front surface, the front surface configured to be seen by a user when the package is open. The liner also includes a printable portion positioned on the front surface, the printable portion configured to receive ink. The system further comprises a printer coupled to the package assembler, the printer configured to dispense the ink on the printable portion when the package is in an at least partially assembled state.

6 Claims, 7 Drawing Sheets

(56) References Cited

U.S. PATENT DOCUMENTS 4,784,261 A * 11/1988 Kutchin ..... B65D 85/1072 206/256
4,813,288 A * 3/1989 Gamberini ..... B65B 19/28 250/223 R
4,836,378 A * 6/1989 Lephardt ..... B65D 75/66 229/203
4,852,734 A 8/1989 Allen et al.
4,865,198 A * 9/1989 Butler ..... B41M 3/14 206/459.1
4,911,302 A * 3/1990 Butler ..... B65B 61/025 200/459
5,682,986 A 11/1997 Cobler
5,806,281 A * 9/1998 Krul ..... B65D 75/66 53/477
6,173,551 B1 * 1/2001 Bowman, Jr. ..... B65C 9/46 53/64
6,766,951 B2 7/2004 Von Bismarck et al.
10,463,074 B2 * 11/2019 Sebastian ..... B65B 19/12
2001/0010332 A1 * 8/2001 Bismarck ..... B65D 85/10 235/435
2003/0052020 A1 * 3/2003 Draghetti ..... B65D 85/1081 206/245
2005/0145259 A1 * 7/2005 Focke ..... B65B 19/28 131/282
2008/0152756 A1 * 6/2008 Ream ..... A23G 3/0097 53/493
2008/0230410 A1 9/2008 Jones et al.
2010/0248926 A1 9/2010 Pipes et al.
2010/0287890 A1 * 11/2010 Polloni ..... B65B 61/02 53/461
2011/0042249 A1 2/2011 Guerrera et al.
2015/0264319 A1 * 9/2015 Wood ..... B65B 19/30 348/125
2016/0075077 A1 * 3/2016 Boegli ..... B65D 25/205 235/494
2021/0171227 A1 * 6/2021 Schlenker ..... B65B 43/12

FOREIGN PATENT DOCUMENTS

EP 0905027 A1 3/1999
EP 2253547 A1 11/2010
EP 3013694 A1 5/2016
WO WO-20150192930 A1 12/2015

* cited by examiner

SYSTEM AND METHOD FOR PRINTING ON A PACKAGE

CROSS-REFERENCE TO RELATED APPLICATIONS

This application is a Divisional of U.S. patent application Ser. No. 16/793,454; filed Feb. 18, 2020, the disclosure of which is hereby incorporated by reference in its entirety in this application.

TECHNICAL FIELD

The present disclosure relates to packages for products such as cigarettes.

BACKGROUND

Cigarettes and other smoking articles are commonly sold in packages, each package often containing a particular number of cigarettes. One type of popular cigarette package employs a container having the form of a so-called "hard-pack," "crush proof box," or "hinged lid package." Such a package may include a lower base (e.g., receptacle) portion and a hinged upper lid portion. These types of packages are typically formed from cardboard or paperboard blanks that include various panels and flaps, which when folded form the lower base portion and the upper lid portion. See, for example, U.S. Pat. No. 3,874,581 to Fox et al.; U.S. Pat. No. 3,944,066 to Niepmann; U.S. Pat. No. 4,852,734 to Allen et al.; European Pat. 0392737 to Moeller; U.S. Pub. Pat. App. No. 2008/0230410 to Jones et al.; U.S. Pub. Pat. App. No. 2011/0042249 to Guerrera et al.; U.S. Pub. Pat. App. No. 2010/0248926 to Pipes et al.; and U.S. Pat. No. 5,682,986 to Cobler, each of which is incorporated herein by reference.

Such packs may include a liner (typically made from foil or foil lined paper) that fits within the base and is configured to contain the smoking articles. The liner serves to prevent moisture from damaging the smoking articles and maintain freshness.

In addition to maintaining the freshness and quality of the product, such packages may be utilized to communicate information to a consumer. For instance, graphics and text are typically applied to the exterior of the lower base and/or lid to communicate various information regarding the product, including branding, advertising, regulatory information, nutritional information, and promotional information. Conventional cigarette packages are often relatively small in size and may have a limited visible exterior surface area for providing information. Thus, the information that may be provided via the available display surfaces may also be limited.

Providing additional surfaces to convey information can require adding material to the package, which increases costs. Furthermore, adding information to a liner can present challenges, as printing with ink on foil is difficult because foil does not absorb ink.

SUMMARY

One embodiment relates to a system for assembling a package for one or more smoking articles. In this embodiment, a package assembler is configured to receive an outer blank and fold the outer blank around a liner to assemble the package, the liner configured to receive one or more smoking articles. According to this embodiment, the liner comprises a material configured to absorb a printing material, a front surface configured to be seen by a user when the package is open, and a printable portion positioned on the front surface, the printable portion configured to receive the printing material. In this embodiment, a printer is coupled to the package assembler, with the printer configured to dispense the printing material on the printable portion when the package is in an at least partially assembled state.

Another embodiment relates to a system for assembling a package. In this embodiment, a package assembler is configured to receive an outer blank and fold the outer blank around a liner to assemble the package, the liner configured to receive one or more smoking articles. The liner of this embodiment comprises a material configured to absorb a printing material, a front surface configured to be seen by a user when the package is open, and a printable portion positioned on the front surface, the printable portion configured to receive the printing material. In this embodiment, a printer is coupled to the package assembler, with the printer configured to dispense the printing material on the printable portion when the package is in at least partially assembled state.

Still another embodiment relates to a method for printing on a liner for a package to receive smoking articles. In this embodiment, the liner is provided to a package folding section of a package assembler. The liner, in this embodiment, comprises a material configured to absorb ink, a front surface configured to be seen by a user when the package is open, and a printable portion positioned on the front surface, the printable portion configured to receive the ink. In this embodiment, an outer blank is provided to the package folding section. In this embodiment, the outer blank is folded around the liner to assemble the package. Information is printed on the printable portion with the ink in this embodiment when the package is in an at least partially assembled state.

Yet another embodiment relates to a system for assembling a package for one or more smoking articles. In this embodiment, a package assembler is configured to receive an outer blank and fold the outer blank around a liner and an inner portion to assemble the package. In this embodiment, the inner portion comprises a material configured to absorb ink and a face, with the face configured to receive ink and to be seen by a user when the package is open. In this embodiment, a printer is coupled to the package assembler and is configured to dispense the ink on the face when the package is in an at least partially assembled state.

An additional embodiment relates to a package to receive smoking articles. In this embodiment, the package includes an outer portion formed from an outer blank, an inner portion formed from an inner portion blank, and a liner formed from a liner blank. In this embodiment, the liner is positioned adjacent to the smoking articles. The inner portion, in this embodiment, is positioned around the liner and within the outer portion and is configured to provide structural support to the outer portion. The outer portion, in this embodiment, includes an outer top and an outer base. In this embodiment, the outer top is configured to pivot relative to the outer base to open the package and expose the inner portion, the liner, and the smoking articles. A front surface of the liner and a face of the inner portion, in this embodiment, are visible to a user when the package is open. In this embodiment, the front surface of the liner and the face of the inner portion are configured to receive a printing material such that a user can view the printing material when the package is open.

A further embodiment relates to a package to receive smoking articles. In this embodiment, the package is assembled by a by a process of having an outer blank, a liner blank, an inner portion blank, and a plurality of smoking articles received at a package assembler. The plurality of smoking articles are secured, in this embodiment, by folding the liner blank around the plurality of smoking articles, thereby creating a liner with a front surface that includes a printable portion. In this embodiment, the inner portion blank is folded around the liner, thereby creating an inner portion that includes a face. The outer blank, in this embodiment, is folded around the inner portion, thereby creating the package that includes an outer base and an outer top, with the inner portion is positioned within the outer base. In this embodiment, printable material is printed on the printable portion and/or the face when the package is partially or fully assembled, using a printer coupled to the package assembler. In this embodiment, the printable material is viewable by a user when the outer top is pivoted relative to the outer base.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several implementations in accordance with the disclosure and are therefore not to be considered limiting of its scope, the disclosure will be described with additional specificity and detail through use of the accompanying drawings. Exemplary embodiments of the present application will now be described, by way of example only, with reference to the accompanying drawings, which are not necessarily drawn to scale, and wherein:

DETAILED DESCRIPTION

Referring generally to the figures, a package for a smoking article is shown. An example of a smoking article is a cigarette. Smoking articles are generally housed in a pack that includes an inner liner to preserve freshness of the smoking articles. The package described herein includes a liner formed from paper that is integrated into the pack during a package folding process. Because the liner is paper, the liner can receive a printing material (e.g., ink, toner, dye, etc.) from a printer such that additional information can be displayed to a consumer. Embodiments described herein provide for a plain liner blank (e.g., the liner blank does not include printing on the liner blank prior to being formed into a liner) that is integrated into a pack during the package folding process. While the plain liner blank is being folded into a liner during the package folding process, a printer prints additional information on a portion of the liner that is visible to a consumer when the consumer opens the pack.

Figure 1:
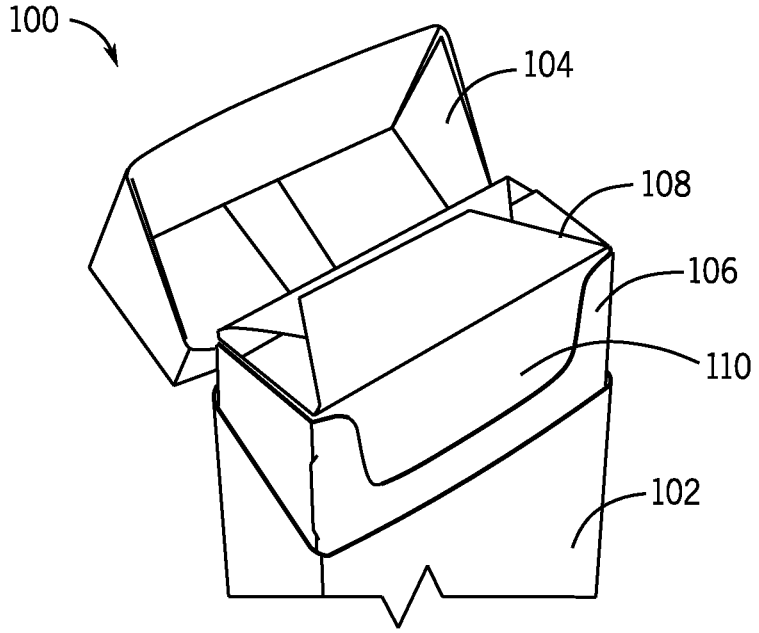
FIG. 1 is a perspective view of a conventional package with a foil liner.

Referring now to FIG. 1, a perspective view of a conventional package 100 with a foil liner 108 is shown. The conventional package 100 includes an outer base 102 and an outer top 104. The outer base 102 and the outer top 104 are constructed from cardboard, paperboard, or a similar material. The outer base 102 is coupled to the outer top 104 by a hinge (not shown) such that the outer top 104 can pivot relative to the outer base 102 and provide access to the interior of the conventional package 100. An inner portion 106 is coupled to, and may be formed integrally with, the outer base 102.

The conventional package 100 begins as a blank. As referred to herein, a "blank" is a substantially flat piece of cardboard or paperboard (or other suitable material) that includes various score lines, perforations, and/or cuts such that the blank can be folded and formed into the conventional package 100. To convey information to a user (e.g., information about the brand, manufacturer, warnings, etc.), the information is printed on the blank such that, when the blank is folded into the conventional package 100, the information is visible to the user on the outer top and the outer base.

The foil liner 108 is constructed from foil, foil-lined paper, or a similar material, and is configured to fit within the inner portion 106 and enclose a plurality of smoking articles so as to prevent damage to the plurality of smoking articles from moisture. The foil liner 108 includes a front surface 110 that is visible to a user when the user opens the conventional package 100 by pivoting the outer top 104 relative to the outer base 102. Conveying additional information to a user via the front surface 110 presents various difficulties. Because foil and/or foil-lined paper is not absorbent, additional information cannot be printed on the front surface 110 with ink because the material of the foil liner 108 (e.g., foil) cannot absorb ink. In some embodiments, additional information can be conveyed by embossing the front surface 110. However, the front surface 110 must be embossed prior to being folded (e.g., when the foil liner 108 is in a flat condition) rather than during the folding process because the force required to emboss the front surface 110 would cause damage to the foil liner 108. Furthermore, embossing information on the front surface 110 would be difficult to read, as the embossed portion of the front surface 110 would be the same color as the rest of the front surface 110 (e.g., the color of the foil).

Figure 2A:
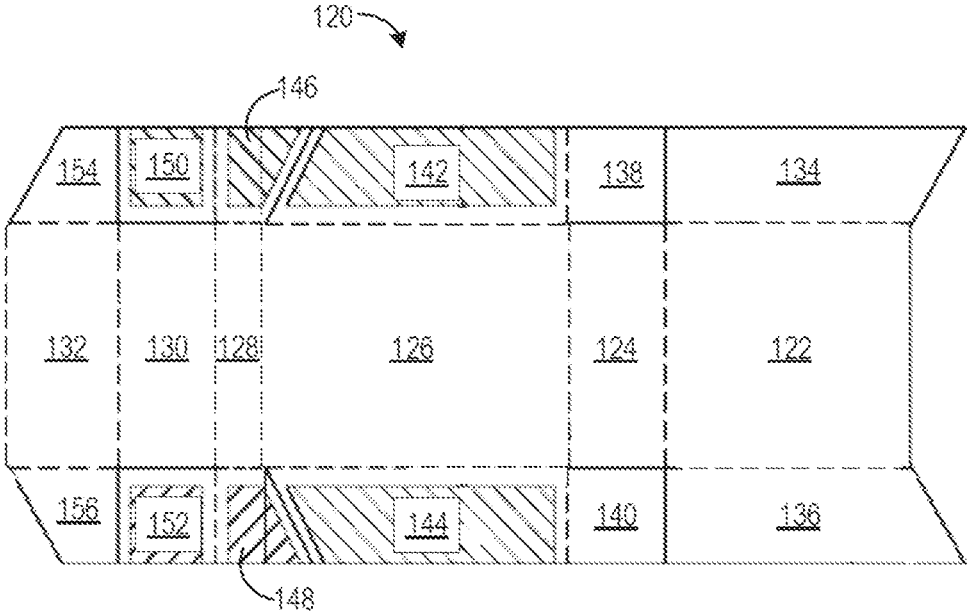
FIG. 2A is an illustration of an outer blank, according to a particular embodiment.

FIG. 2A is an illustration of an outer blank 120, according to a particular embodiment. The outer blank 120 of the illustrated embodiment is substantially flat and comprises one or more sheets of paper material (e.g., paperboard, cardboard, etc.) configured such that the outer blank 120 can be folded. The outer blank 120 of this embodiment is comprised of various portions and flaps to facilitate folding the outer blank 120 into a package. In some embodiments, the outer blank 120 may include images (e.g., the outer blank 120 may include printing) related to the manufacturer of the package. The portions of the outer blank 120 include a front lower portion 122, a bottom portion 124, a back lower portion 126, a back upper portion 128, a top portion 130, and a front upper portion 132. The front lower portion 122 of the illustrated embodiment is separated from the bottom portion 124 by a perforation, a score mark, or any other type of surface modification on the outer blank 120 that facilitates folding. Additionally, each portion of the outer blank 120 of this embodiment is separated from adjacent portions by similar surface modifications to facilitate folding. For example, the bottom portion 124 is separated from both the front lower portion 122 and the back lower portion 126 by a perforation, a score mark, etc.

A first lower portion side flap 134 and a second lower portion side flap 136 are coupled to opposite sides of the front lower portion 122 of the illustrated embodiment. in some embodiments, each of the first lower portion side flap 134 and the second lower portion side flap 136 are separated from the front lower portion 122 by a perforation, a score mark, or any other type of surface modification on the outer blank 120 that facilitates folding such that the first lower portion side flap 134 and the second lower portion side flap 136 can be folded relative to the front lower portion 122.

A third lower portion side flap 142 and a fourth lower portion side flap 144 are coupled to opposite sides of the back lower portion 126 of this embodiment. in some embodiments, each of the third lower portion side flap 142 and the fourth lower portion side flap 144 are separated from the back lower portion 126 by a perforation, a score mark, or any other type of surface modification on the outer blank 120 that facilitates folding such that the third lower portion side flap 142 and the fourth lower portion side flap 144 can be folded relative to the back lower portion 126.

A first bottom portion side flap 138 and a second bottom portion side flap 140 are coupled to opposite sides of the bottom portion 124 of the illustrated embodiment. in some embodiments, each of the first bottom portion side flap 138 and the second bottom portion side flap 140 are separated from the bottom portion 124 by a perforation, a score mark, or any other type of surface modification on the outer blank 120 that facilitates folding such that the first bottom portion side flap 138 and the second bottom portion side flap 140 can be folded relative to the bottom portion 124.

The front lower portion 122, the bottom portion 124, and the back lower portion 126 are folded relative to each other to create an outer base of a package similar to the outer base 102 of this embodiment. In some embodiments, the front lower portion 122 and the back lower portion 126 are folded toward each other by folding relative to the bottom portion 124. In addition, in some embodiments, the flaps associated with each of the front lower portion 122, the bottom portion 124, and the back lower portion 126 are folded so as to contact the flaps associated with the other portions. For example, the first lower portion side flap 134, the first bottom portion side flap 138, and the third lower portion side flap 142 are folded toward each other so as to create a side of an outer base of a package. To maintain the positions of the first lower portion side flap 134, the first bottom portion side flap 138, and the third lower portion side flap 142, in some embodiments each of the side flaps can be coupled to the other side flaps via adhesive or any other suitable coupling mechanism.

A first upper portion side flap 146 and a second upper portion side flap 148 are coupled to opposite sides of the back upper portion 128 of this embodiment. In some embodiments, each of the first upper portion side flap 146 and the second upper portion side flap 148 are separated from the back upper portion 128 by a perforation, a score mark, or any other type of surface modification on the outer blank 120 that facilitates folding such that the first upper portion side flap 146 and the second upper portion side flap 148 can be folded relative to the back upper portion 128.

A first top flap 150 and a second top flap 152 are coupled to opposite sides of the top portion 130 of the illustrated embodiment. In some embodiments, each of the first top flap 150 and the second top flap 152 are separated from the top portion 130 by a perforation, a score mark, or any other type of surface modification on the outer blank 120 that facilitates folding such that the first top flap 150 and the second top flap 152 can be folded relative to the top portion 130.

A third upper portion side flap 154 and a fourth upper portion side flap 156 are coupled to opposite sides of the front upper portion 132 of this embodiment. In some embodiments, each of the third upper portion side flap 154 and the fourth upper portion side flap 156 are separated from the front upper portion 132 by a perforation, a score mark, or any other type of surface modification on the outer blank 120 that facilitates folding such that the third upper portion side flap 154 and the fourth upper portion side flap 156 can be folded relative to the front upper portion 132.

The back upper portion 128, the top portion 130, and the front upper portion 132 are folded relative to each other to create an outer top of a package similar to the outer top 104 of the illustrated embodiment. In some embodiments, the back upper portion 128 and the front upper portion 132 are folded toward each other by folding relative to the top portion 130. In addition, in some embodiments the flaps associated with each of the back upper portion 128, the top portion 130, and the front upper portion 132 are folded so as to contact the flaps associated with the other portions. In some embodiments, the first upper portion side flap 146, the first top flap 150, and the third upper portion side flap 154 are folded toward each other so as to create a side of an outer top of a package. To maintain the positions of the first upper portion side flap 146, the first top flap 150, and the third upper portion side flap 154, in some embodiments each of the side flaps can be coupled to the other side flaps via adhesive or any other suitable coupling mechanism.

Assembled in the manner described, an outer package created from the outer blank 120 will look substantially similar to the outer base 102 and the outer top 104 of the conventional package 100 of this embodiment.

Figure 2B:
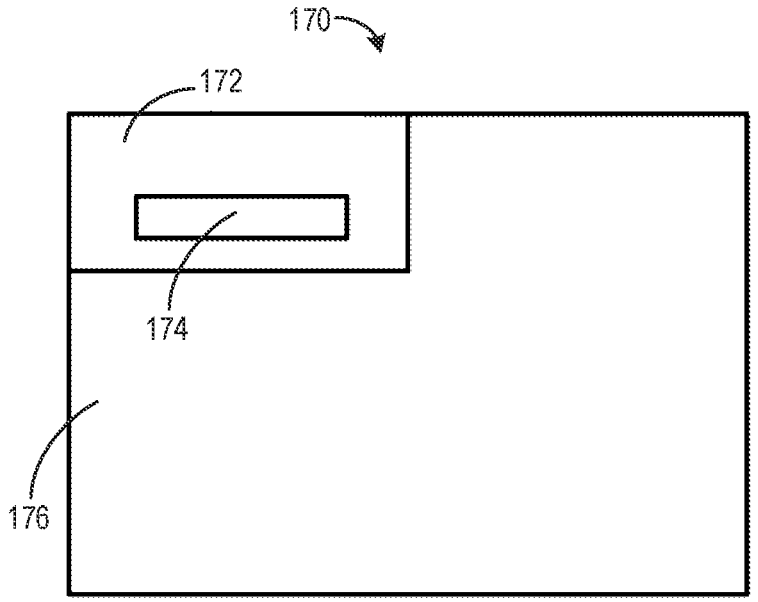
FIG. 2B is an illustration of a liner blank, according to a particular embodiment.

FIG. 2B is an illustration of a liner blank 170, according to a particular embodiment. The liner blank 170 of the illustrated embodiment is substantially flat and comprises one or more sheets of paper material (e.g., paperboard, cardboard, etc.) such that the liner blank 170 can be folded and/or otherwise formed to contain a group of smoking articles. The liner blank 170 of this embodiment includes a front surface 172, a printable portion 174, and a wrapping surface 176. The wrapping surface 176 of the illustrated embodiment is configured to be manipulated (by a machine, by hand, etc.) such that it can be formed to contain a group of smoking articles. Accordingly, the wrapping surface 176 of this embodiment can be folded, rolled, scored, perforated, etc., to accomplish this purpose. The front surface 172 of the illustrated embodiment is configured to be the surface of the liner blank 170 that is visible to a user when the user opens a package of smoking articles. The printable portion 174 of the illustrated embodiment is a portion of the front surface 172 configured to receive a printable material. In some embodiments, the printable portion 174 comprises the front surface 172. In some embodiments, the printable portion 174 can also comprise a smaller area than that of the front surface 172.

Figure 2C:
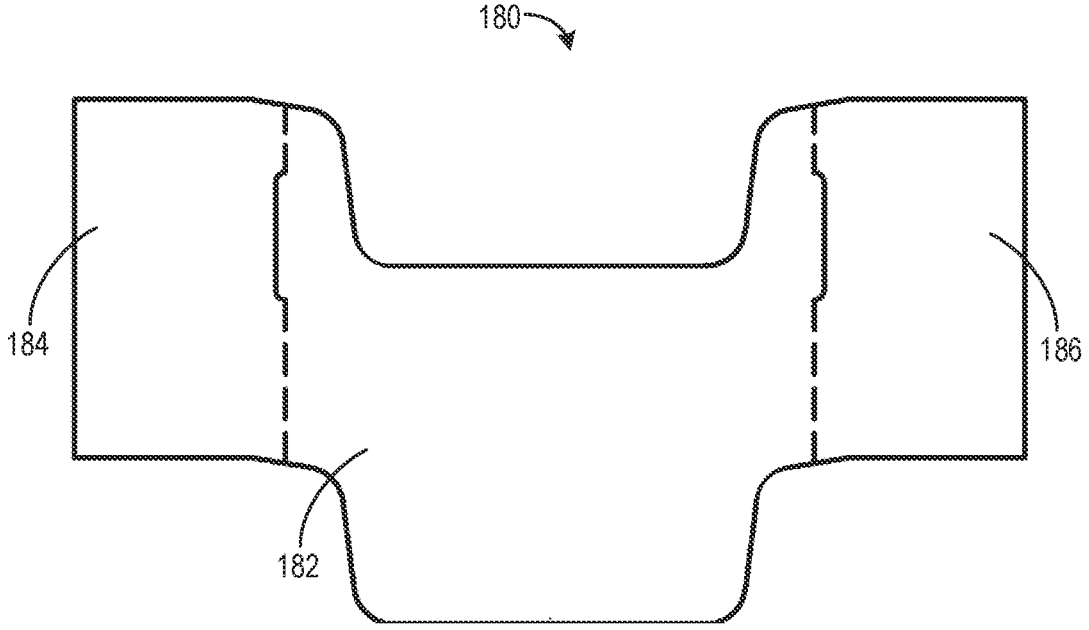
FIG. 2C is an illustration of an inner portion blank, according to a particular embodiment.

FIG. 2C is an illustration of an inner portion blank 180, according to a particular embodiment. The inner portion blank 180 of this embodiment is substantially flat and comprises one or more sheets of paper material (e.g., paperboard, cardboard, etc.) such that the inner portion blank 180 can be folded and/or otherwise formed around the liner blank 170. The inner portion blank 180 includes a face 182, a left side surface 184, and a right side surface 186. The face 182 of the illustrated embodiment is configured to be coupled to the wrapping surface 176 of the liner blank 170 (e.g., via adhesive or other suitable coupling mechanisms) such that the printable portion 174 is visible. The left side surface 184 and the right side surface of this embodiment are configured to wrap around the liner blank 170.

Figure 3A:
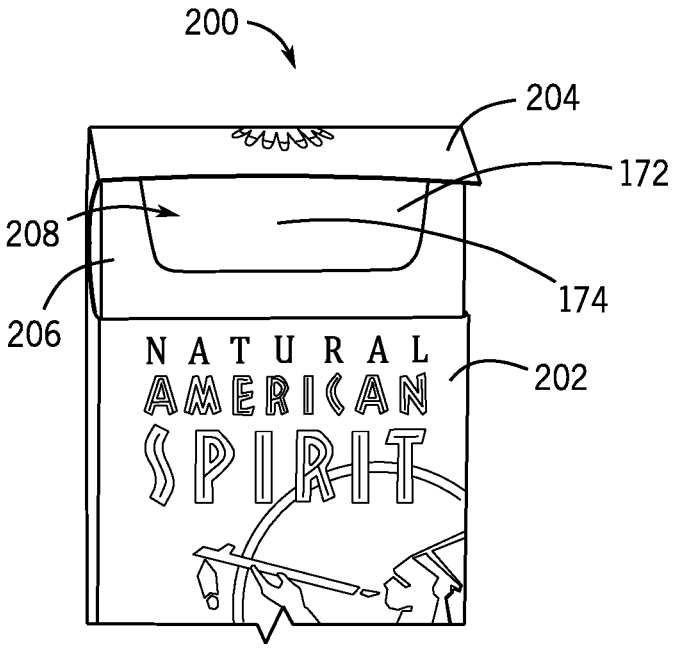
FIG. 3A is an illustration of a package with a liner, according to a particular embodiment.

FIG. 3A is an illustration of a package 200 with a liner 208, according to a particular embodiment. For example, the package 200 of the illustrated embodiment may be formed form the outer blank 120, the liner blank 170, and the inner portion blank 180. The package 200 includes an outer base 202 and an outer top 204. The outer base 202 of this embodiment may be formed from, for example, the front lower portion 122, the bottom portion 124, and the back lower portion 126. The outer top 204 of the illustrated embodiment may be formed from, for example, the back upper portion 128, the top portion 130, and the front upper portion 132. in some embodiments, the outer base 202 is coupled to the outer top 204 by a hinge (not shown) such that the outer top 204 can pivot relative to the outer base 102 and provide access to the interior of the package 200. An inner portion 206 is coupled to, and may be formed integrally with, the outer base 202. The inner portion 206 of the illustrated embodiment may be formed from the inner portion blank 180.

In some embodiments, the outer blank 120, the liner blank 170, and the inner portion blank 180 may be folded to form the package 200 by a package assembler, which will be further described with reference to FIGS. 4A-B.

The liner 208 of this embodiment is configured to fit within the inner portion 106 and enclose a plurality of smoking articles so as to prevent damage to the plurality of smoking articles. In some embodiments, the liner 208 can be formed separately from, or integrally with, the package 200. In some embodiments, the liner 208 includes the front surface 172 that is visible to a user when the user opens the package 200 by pivoting the outer top 204 relative to the outer base 202. The front surface 172 of the illustrated embodiment provides an additional location where information can be conveyed to the user. Because the liner 208 is constructed from paper in some embodiments, the front surface 172 can absorb ink from a printer such that additional information can be presented to a user via the printable portion 174. In some embodiments, the additional information can be preprinted on the liner blank 170 such that, when folded, the front surface 210 displays the printed information. The additional information can also be printed directly on the printable portion 174 during the folding process. Printing directly on the printable portion 174 during the folding process eliminates the need for registration marks on the blank, reduces costs, and increases manufacturing efficiency.

Figure 3B:
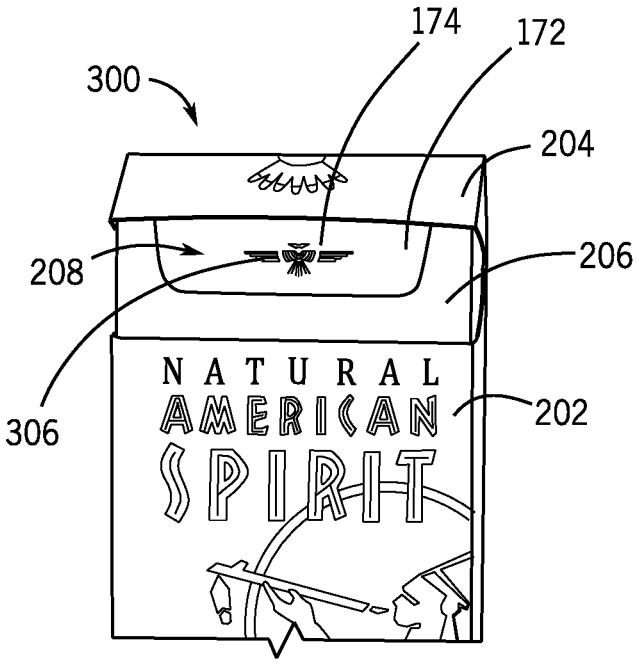
FIG. 3B is an illustration of a package including printing on the liner of FIG. 3A, according to a particular embodiment.

FIG. 3B is an illustration of a package 300 including printing on the liner 208, according to a particular embodiment. The package 300 is substantially similar to the package 200, except that the package 300 includes an image 306 on the liner 208. The image 306 of the illustrated embodiment is printed on the printable portion 174 during the folding process, and can be any type of image that can be printed with a conventional printer. In some embodiments, the image 306 can be a manufacturer's logo. The image 306 can also include pictures and/or words (e.g., instructions, advertisements, etc.). In some arrangements, the image 306 can be a code (e.g., a QR code, a bar code, etc.) that the user can scan with a mobile device (e.g., a mobile phone, a tablet computer, etc.) for additional purposes. For example, the user may be part of a rewards program, and scanning the code may add rewards to the user's account. Scanning the code may also redirect the user's mobile device to a web page with special offers for the user.

Figure 4A:
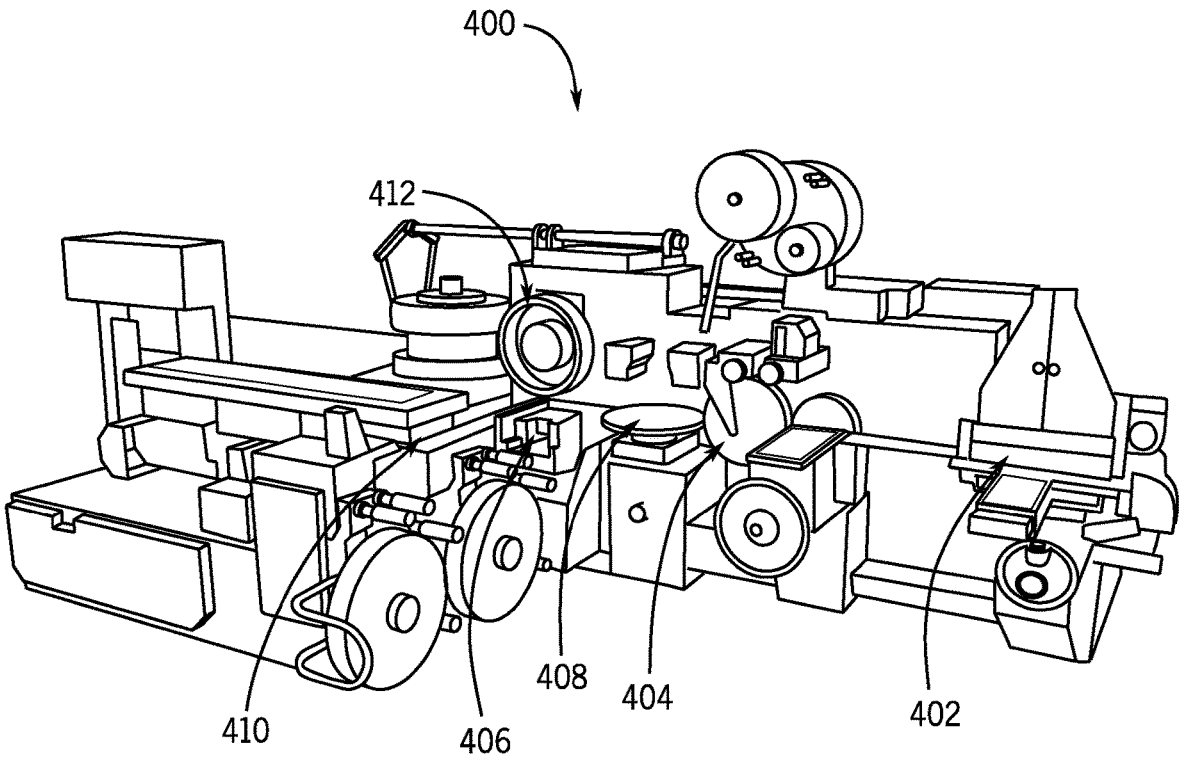
FIG. 4A is an illustration of a packaging assembler, according to a particular embodiment.

FIG. 4A is an illustration of a package assembler 400, according to a particular embodiment. The package assembler 400 of the illustrated embodiment is configured to receive raw materials associated with packaging smoking articles, manipulate the raw materials, and create packages of smoking articles. The raw materials received by the package assembler 400 include, but are not limited to, smoking articles, the outer blank 120, the liner blank 170, and the inner portion blank 180.

The package assembler 400 includes a product feed section 402, a liner forming section 404, an inner portion forming section 406, a coupling section 408, a blank feed section 410, and a package folding section 412.

The product feed section 402 of this embodiment is configured to receive a plurality of smoking articles and sort the plurality of smoking articles such that the smoking articles are positioned to be grouped together. In some embodiments, the product feed section 402 may receive a plurality of cigarettes and position the cigarettes on a conveyor such that additional machinery can separate the cigarettes into groups, with each group configured to fit within a package.

The product feed section 402 of the illustrated embodiment is operably coupled to the liner forming section 404. The liner forming section 404 of this embodiment is configured to receive the liner blank 170 and a group of cigarettes and form the liner 208 around the group of cigarettes. In some embodiments, a group of cigarettes may be placed adjacent to, or in contact with, a portion of the liner blank 170 by the product feed section 402. The liner forming section 404 then manipulates the liner blank 170 around the group of cigarettes to create the liner 208 such that the cigarettes are secured by the liner 208.

The inner portion forming section 406 of this embodiment is configured to receive the inner portion blank 180 and form the inner portion 206 from the inner portion blank 180. In some embodiments, the inner portion forming section 406 may receive the inner portion blank 180 via a conveyor. The inner portion forming section 406 may then manipulate the inner portion blank 180 to create the inner portion 206.

The coupling section 408 of the illustrated embodiment is operably coupled to the liner forming section 404 and the inner portion forming section 406. The coupling section 408 of this embodiment is configured to receive the liner 208 from the liner forming section 404 and the inner portion 206 from the inner portion forming section 406, and couple the liner 208 to the inner portion 206. In some embodiments, the coupling section may apply adhesive to one, or both, of the liner 208 and the inner portion 206 and cause the liner 208 to contact the inner portion 206, thereby coupling the liner 208 to the inner portion 206.

The blank feed section 410 of the illustrated embodiment is configured to receive the outer blank 120 and provide the outer blank 120 to the package folding section 412. In some embodiments, the blank feed section 410 may receive a plurality of the outer blanks 120 and position the plurality of outer blanks 120 on a conveyor such that the conveyor transports the plurality of outer blanks 120 to a subsequent portion of the package assembler 400.

The package folding section 412 is operably coupled to the blank feed section 410 and the coupling section 408. The package folding section 412 of the illustrated embodiment is configured to receive an outer blank 120 from the blank feed section 410 and the coupled liner 208 and inner portion 206 from the coupling section 408 and create a package (e.g., the package 300) by folding the outer blank 120 around the liner 208 and the inner portion 206. In some embodiments, the package folding section 412 may cause the outer blank 120 to be placed adjacent to, or in contact with, the inner portion 206 and/or the liner 208. The package folding section 412 then manipulates (e.g., folds, etc.) the outer blank 120 as described to create the package 300. In some embodiments, the package folding section 412 is also configured to print on the printable portion 174. The package folding section 412 is further described with reference to FIG. 5.

Figure 4B:
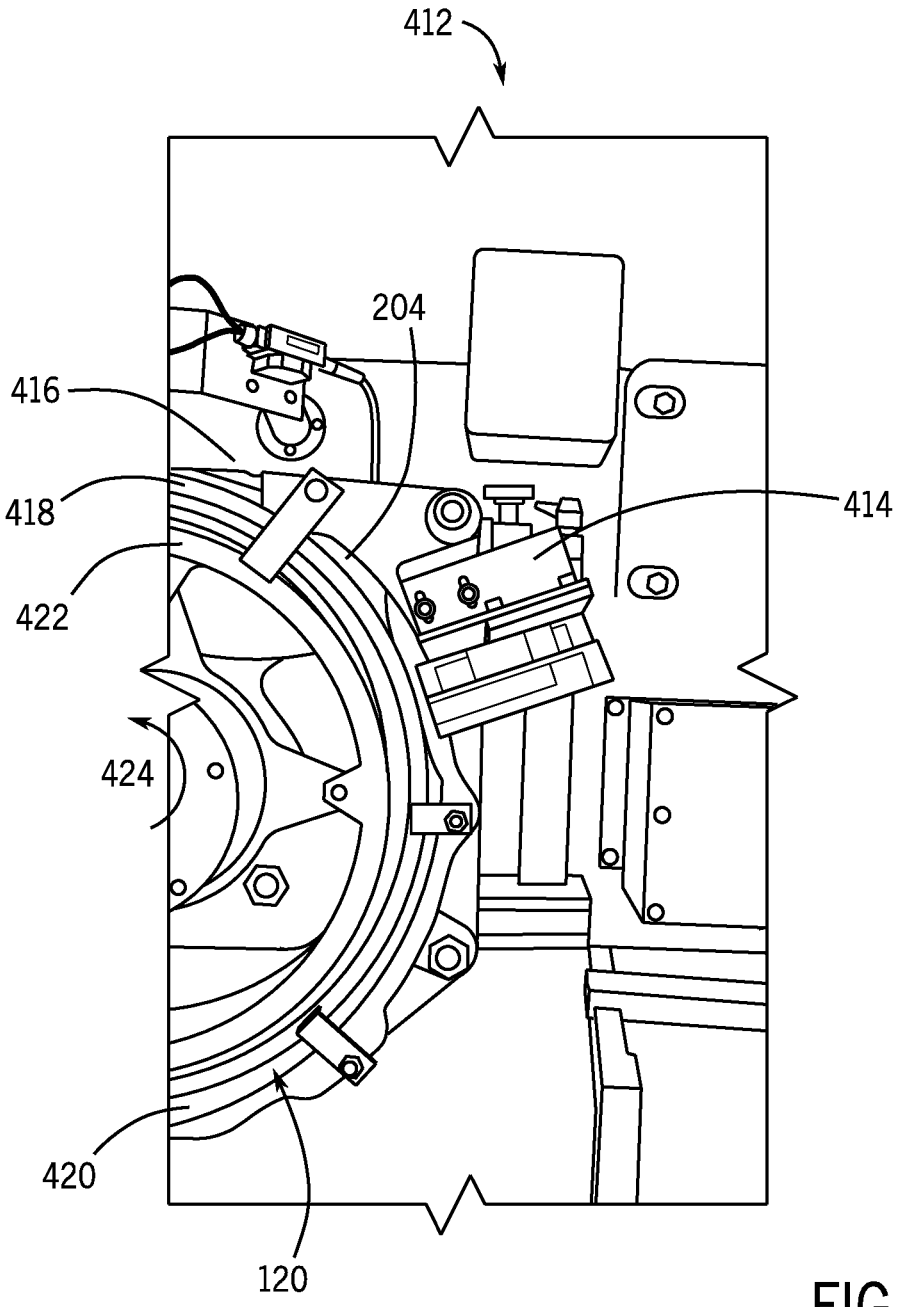
FIG. 4B is a partial view of a package folding section of the package assembler of FIG. 4A.

FIG. 4B is a top view of a portion of the package folding section 412 of the package assembler 400 of FIG. 4A, according to a particular embodiment. The package folding section 412 of this embodiment is configured to receive the outer blank 120 (e.g., the blank for the package 300) and fold the outer blank 120 into the package 300. In some embodiments, the liner 208 and/or the inner portion 206 is placed adjacent to the back lower portion 126 such that the outer blank 120 is folded around the liner 208 and/or the inner portion 206 to create the package 300. The package assembler 400 includes a base 416, a bar 418, a wall 420, and a wheel 422. The wheel 422 of the illustrated embodiment is rotatably coupled to the base 416 and rotates in the direction of the arrow 424 (e.g., counterclockwise). The wheel 422 is configured to be releasably coupled to the outer blank 120 as the outer blank 120 is transported around the package folding section 412.

The bar 418 of the illustrated embodiment is spaced apart from, and is rigidly coupled to, the base 416. The bar 418 of this embodiment is configured to contact one or more of the back upper portion 128, the top portion 130, and the front upper portion 132 (and the corresponding flaps) as the outer blank 120 moves around the base 416. In some embodiments, the distance from the bar 418 to the base 416 decreases as the blank moves around the base 416 such that the bar 418 folds the back upper portion 128, the top portion 130, and the front upper portion 132 to create the outer top 204. The package folding section 412 includes various additional folding elements (e.g., bars, arms, etc.) (not shown) configured to contact one or more of the front lower portion 122, the bottom portion 124, and the back lower portion 126 as the outer blank 120 moves around the base 416. In some embodiments, the additional folding elements fold the front lower portion 122, the bottom portion 124, and the back lower portion 126 to create the outer base 202.

In some embodiments, the package folding section 412 also includes a printer 414 rigidly coupled to the base 416. The printer 414 of the illustrated embodiment can be any type of printer capable of printing on a substrate in a high-speed environment (e.g., where the substrate is moving at a speed greater than approximately 500 meters per minute). In some embodiments, the printer 414 prints in black ink. The printer 414 can also print in color, or in any combination of black and color. The printer 414 of this embodiment is positioned such that a print head of the printer is approximately level with the printable portion 174 as the liner 208 passes by the printer 414. In some embodiments, the printer 414 is positioned and configured to print on the printable portion 174 while the package 300 is being assembled. In other words, the printer 414 prints on the printable portion 174 when one or more of the outer blank 120, the liner blank 170, and the inner portion blank 180 are assembled or partially assembled with each other. The printer 414 does not print on the printable portion 174 prior to one or more of the outer blank 120, the liner blank 170, and the inner portion blank 180 being assembled with each other (e.g., the printer 414 does not print on the printable portion 174 before the liner blank 170 is received by the package assembler 400). In some embodiments, the printer 414 prints on the printable portion 174 when the package 300 is partially assembled (e.g., when one or more of the outer blank 120, the liner blank 170, and the inner portion blank 180 are being manipulated to form the package 300, the liner 208, and the inner portion 206, respectively). The printer 414 can also print on the printable portion 174 after the package 300 is fully assembled.

In some embodiments, the printer 414 is positioned and configured to print on the portion of the face 182 that is visible to the user when the user opens the package 300. Accordingly, embodiments described herein that reference printing on the printable portion 174 also apply to printing on the face 182.

In some arrangements, the printer 414 is controlled by a controller that directs the printer to print when the printable portion 174 passes by the printer 414. The controller may receive information from one or more sensors (e.g., optical sensors, etc.) that notify the controller when the printable portion 174 is in an appropriate position for printing. In some embodiments, a sensor located near the printer 414 may detect a leading edge of the printable portion 174 and notify the controller of the presence of the printable portion 174. The controller then directs the printer 414 to print on the printable portion 174 as the printable portion 174 passes by the print head.

In some embodiments, the controller directs the printer 414 to print based on the speed of the packaging line. For example, the speed of the packaging line may be provided to the controller by an operator. The controller then calculates when the printable portion 174 will pass by the printer 414, and the controller directs the printer 414 to print at the appropriate time.

In some embodiments, printing on the printable portion 174 in the manner described avoids the need to have a preprinted liner, reducing manufacturing costs. In addition, the liner 208 described herein both protects the smoking articles contained in the package and provides a substrate to absorb ink to provide an additional area to communicate with consumers that is not available with a conventional package that includes a foil liner. The outer foil surface of a conventional foil liner is not absorbent, so it cannot absorb ink from a printer. If ink were printed on a conventional foil liner, the ink would remain on the surface of the foil and would be smeared and/or wiped away on contact. A foil liner can be embossed to display additional information, however the embossing process must be completed prior to the folding process because embossing requires the surface of the foil liner to be physically deformed. Causing such a physical deformation during the folding process would damage the smoking articles contained within the foil liner.

Figure 5:
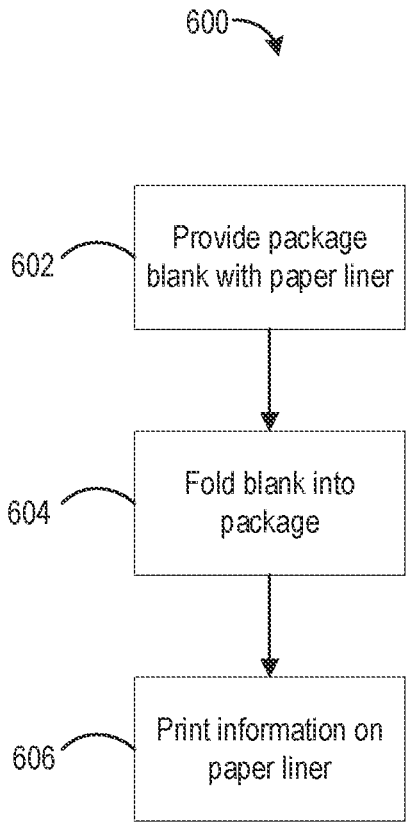
FIG. 5 is an illustration of a method for printing on a paper liner, according to a particular embodiment.

FIG. 5 is an illustration of a method 600 for printing on a paper liner, according to a particular embodiment. At 602, a package blank with a paper liner is provided. For example, the outer blank 120 is provided. In some embodiments, the outer blank 120 of the illustrated embodiment is provided with the liner 208 and the inner portion 206. At 604, the blank is folded into a package. In some embodiments, the outer blank 120 of this embodiment is folded into the package 300 by the package assembler 400. At 606, information is printed on the paper liner. For example, the printer 414 prints information on the printable portion 174. In some embodiments, the printer 414 prints information on the printable portion 174 before the outer blank 120 is completely folded into the package 300. In some embodiments, the printer 414 prints information on the printable portion 174 after the outer blank 120 is completely folded into the package 300.

As utilized herein, the term "substantially," "approximately," and similar terms are intended to have a broad meaning in harmony with the common and accepted usage by those of ordinary skill in the art to which the subject matter of this disclosure pertains. It should be understood by those of ordinary skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

Although only a few embodiments have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter described herein. For example, elements shown as integrally formed may be constructed of multiple components or elements, the position of elements may be reversed or otherwise varied, and the nature or number of discrete elements or positions may be altered or varied. The order or sequence of any method processes may be varied or resequenced according to alternative embodiments. Other substitutions, modifications, changes, and omissions may also be made in the design, operating conditions and arrangement of the various exemplary embodiments without departing from the scope of the present invention.

What is claimed is:

1. A method for printing on a liner for a package to receive smoking articles, comprising:

providing the liner to a package folding section of a package assembler, the liner comprising:

a material configured to absorb ink; and a front surface configured to be seen by a user when the package is opened, wherein a printable portion of the front surface of the liner is configured to receive the ink;

providing an outer blank to the package folding section;

folding the outer blank around the liner to assemble the package; and printing information directly on the printable portion of the front surface of the liner configured to receive the ink with the ink when the package is in an at least partially assembled state.

2. The method of claim 1, wherein the printing of the information on the liner occurs while the outer blank is being folded.

3. The method of claim 1, wherein the printing of the information on the liner occurs after the outer blank is folded.

4. The method of claim 1, further comprising:

controlling, by a controller, a printer configured to print the information on the printable portion of the front surface of the liner, the controller directing the printer to print the information on the printable portion of the front surface of the liner when the package is at least partially assembled.

5. The method of claim 4, further comprising:

receiving, by the controller, sensor data from a sensor, the sensor data comprising a position of the printable portion of the front surface of the liner relative to the printer; and directing, by the controller, the printer to print on the printable portion of the front surface of the liner based upon the sensor data.

6. The method of claim 4, further comprising:

receiving, by the controller, sensor data from a sensor, the sensor data comprising a speed of the printable portion of the front surface of the liner; and directing, by the controller, the printer to print on the printable portion of the front surface of the liner based upon the sensor data.

* * * * *